US006190045B1

(12) United States Patent
Schulman

(10) Patent No.: US 6,190,045 B1
(45) Date of Patent: Feb. 20, 2001

(54) FLEXIBLE STORAGE CONTAINER

(76) Inventor: Dale Schulman, 1061 Schaub Ave., Mobile, AL (US) 36609

( * ) Notice: Under 35 U.S.C. 154(b), the term of this patent shall be extended for 0 days.

(21) Appl. No.: 09/455,429

(22) Filed: Dec. 6, 1999

(51) Int. Cl.[7] ..... B65D 33/14

(52) U.S. Cl. ..... 383/24; 333/41; 333/43; 333/66; 333/67

(58) Field of Search ..... 383/24, 41, 43, 383/66, 67; 312/1

(56) References Cited

U.S. PATENT DOCUMENTS

| | | | | |
|---|---|---|---|---|
| 2,751,952 | * | 6/1956 | Mirus | 383/66 X |
| 3,228,556 | | 1/1966 | Nonestied . | |
| 3,356,120 | | 12/1967 | Nohmura . | |
| 3,708,005 | | 1/1973 | Crain . | |
| 4,684,036 | | 8/1987 | Brewer . | |
| 4,865,401 | * | 9/1989 | Jacobson | 312/1 |
| 4,914,793 | * | 4/1990 | Rampolia et al. | 312/1 X |
| 5,042,687 | | 8/1991 | McKinley . | |
| 5,197,631 | | 3/1993 | Mishima . | |
| 5,285,927 | | 2/1994 | Pruitt . | |
| 5,288,150 | | 2/1994 | Bearman . | |
| 5,341,933 | | 8/1994 | Willows . | |
| 5,451,108 | | 9/1995 | Anderson . | |
| 5,487,467 | | 1/1996 | Sherman . | |
| 5,947,277 | * | 9/1999 | Sherman | 383/41 X |
| 6,012,843 | * | 1/2000 | Brooks et al. | 383/41 X |

FOREIGN PATENT DOCUMENTS

| | | | | |
|---|---|---|---|---|
| 2 268 157 | * | 1/1994 | (GB) | 383/41 |

* cited by examiner

*Primary Examiner*—Jes F. Pascua
(74) *Attorney, Agent, or Firm*—Matthew J. Peirce

(57) ABSTRACT

The present invention would be a tubular bag or container constructed of transparent plastic. The bag or container would include two end mounted holes and two side mounted holes which are carved into the bag or container, allowing easy access. Elastic bands would circumferentially surround the holes and when the elastic bands would be expanded, a user could insert large items into the bag or container to store these items for a particular length of time. As an option, the present invention could be manufactured in a variety of sizes and from different materials, such as nylon or any other washable fabric.

4 Claims, 2 Drawing Sheets

FLEXIBLE STORAGE CONTAINER

BACKGROUND OF THE INVENTION

The present invention is that of a new and improved flexible storage container.

DESCRIPTION OF THE PRIOR ART

There are a wide variety of inventions in the prior art that discuss storage containers. One example is U.S. Pat. No. 5,487,467, issued to Sherman, which discloses a receptacle for plastic shopping bags and like articles comprising an upper member having the general structure and appearance of an upper portion of a doll body, and a lower element structured and disposed for receiving articles therein.

U.S. Pat. No. 5,451,108, issued to Anderson, discloses a container that compromises a tubular body for bags of one size and having an inlet and outlet aperture, and at least one pocket for bags of a different size, the pocket also having an inlet and outlet aperture.

U.S. Pat. No. 5,341,933, issued to Willows, discloses a storage and dispensing device for storing plastic shopping bags and holding them ready for retrieval, and comprises a tube of cloth fabric having an entry opening at the top and a dispensing opening at the bottom.

U.S. Pat. No. 5,288,150, issued to Bearman, discloses a tote bag having a mesh inner liner with a primary opening for depositing articles therein and an outer lining attached to the inner lining, the outer lining having a primary opening and a secondary opening.

U.S. Pat. No. 5,285,927, issued to Pruitt, discloses a container/dispenser that is used for plastic shopping bags which comprises a walled vessel having an open top and an open bottom to which is secured a converging lower section formed of flexible walls with an internal friction surface terminating in the small opening.

U.S. Pat. No. 5,197,631, issued to Mishima, discloses a mechanism for automatically pushing up tissues which includes a box and a pusher.

U.S. Pat. No. 5,042,687, issued to McKinley, discloses a plastic shopping bag container that is used to store randomly disposed shopping bags with a lower horizontal slot for removal of the stored bags.

U.S. Pat. No. 4,684,036, issued to Brewer, discloses a cup dispensing system that employs a housing having a pair of walls with relatively rigid inwardly inclined portions for supporting a stack of cups and enabling individual dispensing of cups.

U.S. Pat. No. 3,708,005, issued to Crain, discloses a device which provides a means for carrying large bulky shirts without unduly wrinkling or compressing them.

U.S. Pat. No. 3,356,120, issued to Nohmura, discloses a flexible container formed by a sheath of windings of a flexible material, embedded in a flexible casing constructed by coating the sheath with a flexible coating material and having a mouthpiece in both the upper and lower openings.

U.S. Pat. No. 3,228,556, issued to Nonestied, discloses a dispensing device and more particularly relates to a device for dispensing tokens or markers used in games of amusement such as lotto, bingo, or the like.

Although a wide variety of inventions that are used to store various devices exist in the prior art, no one invention includes all of the features of the present invention, or is substantially similar to the present invention.

SUMMARY OF THE INVENTION

The present invention would be a tubular bag or container constructed of transparent plastic. The bag or container would include two-end mounted holes and two side-mounted holes which are carved into the bag or container, allowing easy access. Elastic bands would circumferentially surround the holes and when the elastic bands would be expanded, a user would be able to obtain large items such as toys or shoes located within the bag or container. In addition, a user could insert large items into the bag or container to store these items for a particular length of time. As an option, the present invention could be manufactured in a variety of sizes and from different materials, such as nylon or any other washable fabric. The bag or container itself could also be manufactured in a number of colors and designs, including logos for sports teams.

It is therefore an object of the present invention to provide a new and improved storage container.

It is another object of the present invention to provide a new and improved storage container that is flexible.

It is yet another object of the present invention to provide a new and improved storage container that can be easily and efficiently manufactured.

It is still another object of the present invention to provide a new and improved storage container that can be used to store a wide variety of products.

It is still another object of the present invention to provide a new and improved storage container that would allow easy access to the contents of the storage container.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
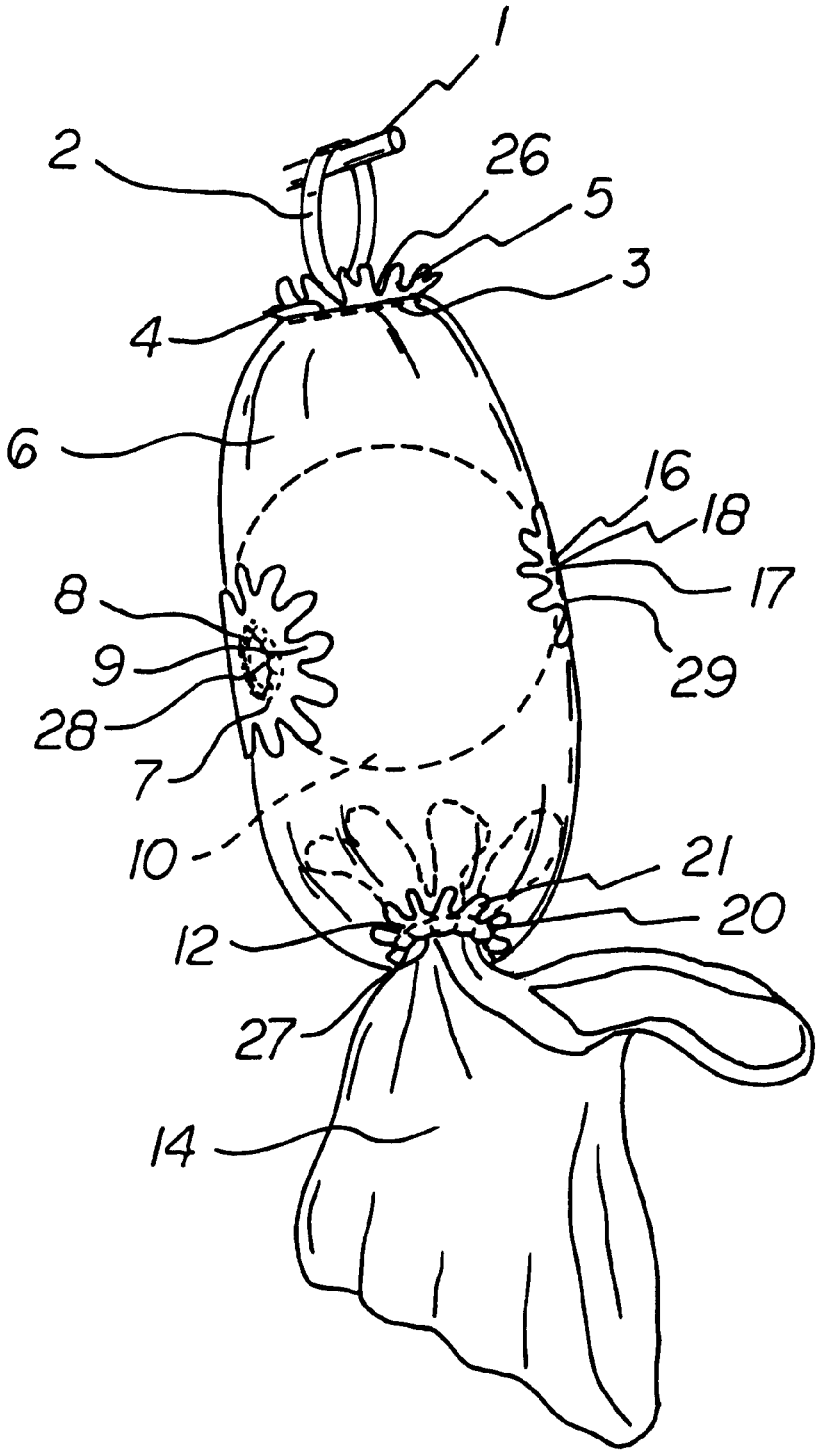
FIG. 1 shows a side view of the container of the present invention.

Referring now to the present invention, FIG. 1 shows a side view of container 6. Container 6 would be a tubular bag constructed of transparent plastic. Container 6 would be roughly in the shape of a sock. Container 6 has a top-mounted hole 26, a bottom-mounted hole 27 and two side-mounted holes 28 and 29.

Top-mounted hole 26 is circumferentially surrounded by elastic band 4, which is kept in place by stitching 3. Top-mounted hole 26 is also surrounded by decorative side panel 5, which comprises extra fabric attached to container 6.

Bottom-mounted hole 27 is circumferentially surrounded by elastic band 12, which is kept in place by stitching 20. Bottom-mounted hole 27 is also surrounded by decorative side panel 21, which comprises extra fabric attached to container 6.

Side-mounted hole 28 is circumferentially surrounded by elastic band 8, which is kept in place by stitching 7. Side-mounted hole 28 is also surrounded by decorative side panel 9, which comprises extra fabric attached to container 6.

Side-mounted hole 29 is circumferentially surrounded by elastic band 18, which is kept in place by stitching 16.

Side-mounted hole 29 is also surrounded by decorative side panel 17, which comprises extra fabric attached to container 6.

Container 6 can be used to store or contain certain items when any of the elastic bands of the present invention are expanded. Shown as examples of possible items that the present invention could contain are toy ball 10, which is completely contained within the present invention, and bag 14, which is shown being removed from container 6 through elastic band 12.

Container 6 also has a top mounted elastic loop 2, which would allow container 6 to be mounted in a wide variety of places. In FIG. 1, container 6 is shown attached to post 1 by hanging elastic loop 2 on post 1.

Figure 2:
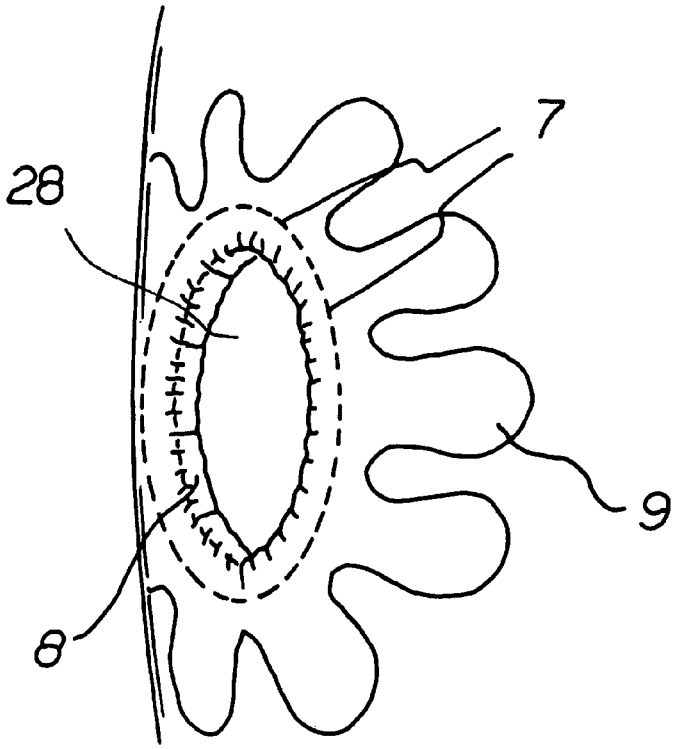
FIG. 2 shows a closeup side view of one of the side mounted elastic holes in the present invention.

FIG. 2 shows a closeup side view of side-mounted hole 28, with elastic band 8, stitching 7, and side panel 9. The other three elastic bands and associated parts on the present invention are identical to the parts shown in FIG. 2.

Figure 3:
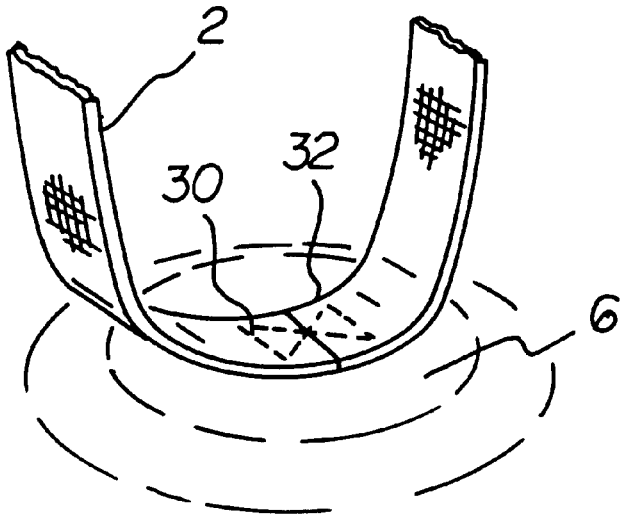
FIG. 3 shows a closeup view of the elastic loop attached to the container of the present invention.

FIG. 3 shows elastic loop 2 attached to container 6. Elastic loop 2 is made from elastic and has two ends, first end 30 and second end 32. First end 30 and second end 32 are preferably attached to the top of container 6 by an "X" pattern of stitching that is used in conjunction with perimeter stitching.

What I claim as my invention is:

1. A storage container, said storage container comprising a length of transparent plastic shaped into a tubular bag, said tubular bag including two ends, a top end and a bottom end, said tubular bag including a top mounted hole at said top end, wherein said top mounted hole further comprises an elastic band, said elastic band being circumferentially attached to the perimeter of said top mounted hole, said elastic band allowing said top mounted hole to be expanded or retracted as desired, said tubular bag including a bottom mounted hole in said bottom end, and said tubular bag including two side mounted holes, each of said side mounted holes being located approximately half way between said top mounted hole and said bottom mounted hole, and each of said side mounted holes being mounted approximately 180 degrees apart from each other on the surface of said tubular bag.

2. A storage container according to claim 1, wherein said bottom mounted hole further comprises an elastic band, said elastic band being circumferentially attached to the perimeter of said bottom mounted hole, said elastic band allowing said bottom mounted hole to be expanded or retracted as desired.

3. A storage container according to claim 1, wherein each of said side mounted holes further comprises an elastic band, each of said elastic bands being circumferentially attached to the perimeter of each of said side mounted holes, and each of said elastic bands allowing each of said side mounted holes to be expanded or retracted as desired.

4. A storage container according to claim 1, wherein said storage container further comprises an elastic loop, said loop including two ends, a first end and a second end, said first end being fixedly attached to said storage container near said top mounted hole, and said second end being fixedly attached to said storage container near said top mounted hole.

* * * * *